US010180299B2

(12) United States Patent
Morreau

(10) Patent No.: US 10,180,299 B2
(45) Date of Patent: Jan. 15, 2019

(54) FLASH SUPPRESSOR ASSEMBLY AND METHOD

(71) Applicant: M Combat, Inc., Wilmer, AL (US)

(72) Inventor: David R. Morreau, Wilmer, AL (US)

(73) Assignee: M COMBAT, INC., Wilmer, AL (US)

( * ) Notice: Subject to any disclaimer, the term of this patent is extended or adjusted under 35 U.S.C. 154(b) by 0 days.

(21) Appl. No.: 15/875,684

(22) Filed: Jan. 19, 2018

(65) Prior Publication Data

US 2018/0266783 A1 Sep. 20, 2018

Related U.S. Application Data

(60) Provisional application No. 62/471,399, filed on Mar. 15, 2017.

(51) Int. Cl.
*F41A 21/34* (2006.01)
*F41A 21/30* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34
See application file for complete search history.

(56) References Cited

U.S. PATENT DOCUMENTS 2,503,491 A * 4/1950 Janz ..... F41A 21/30 181/223
2,514,996 A * 7/1950 Faust, Jr. ..... F41A 21/30 181/223
2,765,706 A * 10/1956 Strohl ..... F41A 21/36 89/14.3
4,974,489 A * 12/1990 Fishbaugh ..... F41A 21/30 89/14.4
5,029,512 A * 7/1991 Latka ..... F41A 21/30 181/223
5,136,923 A * 8/1992 Walsh, Jr. ..... F41A 21/30 89/14.2
8,807,272 B2 * 8/2014 Bladen ..... F41A 21/30 181/223
2014/0216237 A1 * 8/2014 Butler ..... F41A 21/36 89/14.4
2017/0205175 A1 * 7/2017 Garst ..... F41A 21/30
2018/0038663 A1 * 2/2018 Larue ..... F41A 3/66

FOREIGN PATENT DOCUMENTS

DE 102011116060 A1 * 4/2013 ..... F41A 21/30
GB 356224 A * 8/1931 ..... F41A 21/30
WO WO-2017157499 A2 * 9/2017 ..... F41A 21/30

OTHER PUBLICATIONS

Machine translation of WO 2017/157499 A2 (Year: 2017).*
International Search Report and Written Opinion dated Oct. 1, 2018, from Applicant's counterpart International Patent Application No. PCT/US2018/20687.

* cited by examiner

*Primary Examiner* — Joshua T Semick
(74) *Attorney, Agent, or Firm* — Jones Walker LLP

(57) ABSTRACT

A flash suppressor assembly that captures, burns, and cools the combustion gases produced when a projectile, such as a bullet, is fired by a weapon. The flash suppressor assembly includes a housing with an internal space containing a tubular burn chamber disposed about a burn tube that define at least one set of an accelerated gas flow chamber, an expanded burn chamber, and an elongated cooling chamber. The outer surface profile of the burn tube includes grooves that facilitate the intermixing of oxygen with the combustion gases to enhance burning thereof.

20 Claims, 8 Drawing Sheets

FLASH SUPPRESSOR ASSEMBLY AND METHOD

CROSS-REFERENCE TO RELATED APPLICATIONS

This application claims the benefit of and priority to U.S. Provisional Patent Application No. 62/471,399, filed on Mar. 15, 2017, which is incorporated by reference herein.

BACKGROUND OF THE DISCLOSURE

The disclosure relates to flash suppressor assemblies for weapons.

A flash suppressor, also known as a flash guard, flash eliminator, flash hider, or flash cone, is a device attached to the muzzle of a rifle that reduces its visible signature while firing by cooling or dispersing the burning gases that exit the muzzle. The flash suppressor reduces the chances that the shooter will be blinded in low-light shooting conditions. Secondarily, the flash suppressor reduces the intensity of the flash visible to others, as for example, enemy combatants.

Flash is more prevalent with shorter length barrels commonly used with today's firearms. Flash can be a serious problem during night-time combat because the flash interferes with the shooter's night vision and may make the shooter's position more apparent. Flash suppressors are designed to reduce the muzzle flash from the weapon to preserve the shooter's night vision by diverting the incandescent gases to the sides, away from the line of sight of the shooter, and to secondarily reduce the flash visible to the enemy. Military forces engaging in night combat are still visible when firing, especially with night vision gear, and must move quickly after firing to avoid receiving return fire.

Flash suppressors reduce, or in some cases eliminate, the flash by rapidly cooling the gases as they leave the end of the barrel. Although the overall amount of burning propellant is unchanged, the density and temperature are greatly reduced, as is the brightness of the flash.

Despite developments in flash suppressor technology, the need still remains for an improved flash suppressor that reduces or eliminates flash.

SUMMARY OF THE DISCLOSURE

In one embodiment of a flash suppressor assembly, the assembly may include a housing. The housing may have a first end and a second end. The housing may include an internal space. The assembly may also include a tubular burn chamber disposed within the internal space of the housing. The tubular burn chamber may have a first end operatively connected to the first end of the housing and a second end operatively connected to the second end of the housing. The tubular burn chamber may include an internal portion. The assembly may also include a receiver detachably secured at the first end of the housing. The receiver may be configured for detachable fixation to a barrel muzzle. The receiver may include an internal bore wall defining a bore for receiving and transporting a projectile fired by a weapon. The receiver may extend into the internal portion of the tubular burn chamber. The assembly may also include a burn tube operatively positioned in axially alignment with the receiver. The first end of the burn tube may be operatively supported by an end of the receiver. The second end of the burn tube may be operatively connected to the second end of the housing. The burn tube may be disposed within the internal portion of the tubular burn chamber. The burn tube may include an internal bore wall defining a bore for receiving and transporting the projectile.

The embodiment of the flash suppressor assembly may also include a first chamber defined by a first inner wall surface portion of the tubular burn chamber and a first outer wall surface portion of the receiver. The first chamber may receive, through one or more openings in the bore wall of the receiver, a combustion gas produced by the firing of the projectile. The assembly may also include a second chamber defined by a second inner wall surface portion of the tubular burn chamber and a second outer wall surface portion of the receiver and a first portion of a first outer wall section of the burn tube. The volume area of the second chamber may be less than a volume area of the first chamber such that the combustion gas flowing from the first chamber to the second chamber is accelerated by compression in the second chamber. The assembly may also include a third chamber defined by a third inner wall surface portion of the tubular burn chamber and a second portion of the first outer wall section of the burn tube. The volume area of the third chamber may be greater than the volume area of the second chamber such that the accelerated combustion gas flowing from the second chamber to the third chamber is expanded in the third chamber and burns with an intermixing of the combustion gas with oxygen. The assembly may also include a fourth elongated chamber defined by a fourth inner wall surface portion of the tubular burn chamber and a second and third outer wall sections of the burn tube. The fourth inner wall surface may be profiled with spiral threads. The spiral threads may cause the burning gas to spin to facilitate burning and cooling of the burned gas as the burned gas flows through the fourth elongated chamber. The assembly may also include a plurality of gas vents disposed in the second end of the housing for transmission of the burned gas from the fourth elongated chamber to the exterior of the flash suppressor assembly.

In another embodiment of the flash suppressor assembly, the first outer wall section of the burn tube may include a plurality of grooves that facilitate the intermixing of oxygen with the combustion gas to promote burning.

In another embodiment of the flash suppressor assembly, the second and third outer wall sections of the burn tube may include a plurality of grooves that facilitate the intermixing of oxygen with the combustion gas to promote burning.

In another embodiment of the flash suppressor assembly, the first outer wall section of the burn tube may have a decreasing tapered profile in the direction of the second end of the housing.

In another embodiment of the flash suppressor assembly, the second outer wall section of the burn tube may have a decreasing tapered profile in the direction of the second end of the housing.

In another embodiment of the flash suppressor assembly, the third outer wall section of the burn tube may have an increasing tapered profile in the direction of the second end of the housing.

In another embodiment of the flash suppressor assembly, the second inner wall surface portion of the tubular burn chamber may have a decreased inner diameter in relation to an inner diameter of the first inner wall portion of the tubular burn chamber.

In another embodiment of the flash suppressor assembly, the third inner wall surface portion of the tubular burn chamber may have an increased inner diameter in relation to the decreased inner diameter of the second inner wall portion of the tubular burn chamber.

In another embodiment of the flash suppressor assembly, the assembly may further comprise a fifth chamber defined by a fifth inner wall surface portion of the tubular burn chamber and an end portion of the third outer wall section of the burn tube. The fifth chamber may receive and slow the transmission of the burned and cooled gas from the fourth chamber and transmit the slowed burned and cooled gas through the plurality of gas vents to the exterior of the flash suppressor assembly.

In another embodiment of the flash suppressor assembly, the housing may include an outer sleeve having a first end and a second end, a base cap, and an end cap. The first end of the outer sleeve may be operatively connected to the base cap and the second end of the outer sleeve may be operatively connected to the end cap. The first end of the tubular burn chamber may be operatively connected to the base cap and the second end of the tubular burn chamber may be operative connected to the end cap.

In another embodiment of the flash suppressor assembly, the assembly may comprise an insulating sleeve disposed between the outer sleeve and the tubular burn chamber. The insulating sleeve may include a first end operatively positioned on the base cap and a second end operatively positioned on the end cap.

In another embodiment of the flash suppressor assembly, the base cap may include a tapered surface for directional movement of the combustion gas in the direction towards the end cap.

In another embodiment of the flash suppressor assembly, the receiver may include an enlarged diameter section for detachable connection to the barrel muzzle and a side wall section. The side wall section may contain the openings from the bore wall.

In another embodiment of the flash suppressor assembly, the side wall section of the receiver may terminate at an end tip and the first end of the burn tube may contain a lip. The end tip of the side wall section of the receiver may be received into the lip of the first end of the burn tube to thereby support the burn tube in axial alignment with the receiver.

In yet another embodiment of the flash suppressor assembly, the assembly may comprise a housing including an outer sleeve having a first end and a second end, a base cap, and an end cap. The first end of the outer sleeve may be operatively connected to the base cap and the second end of the outer sleeve may be operatively connected to the end cap. The end cap may include a plurality of gas vents. The housing may include an internal space. The assembly may also include a tubular burn chamber disposed within the internal space of the housing. The tubular burn chamber may have a first end operatively connected to the base cap and a second end operatively connected to the end cap. The tubular burn chamber may include an internal portion. The assembly may also include a receiver detachably secured to the base cap. The receiver may be configured for detachable fixation to a barrel muzzle. The receiver may include an internal bore wall defining a bore for receiving and transporting a projectile fired by a weapon. The receiver may extend into the internal portion of the tubular burn chamber. The assembly may also include a burn tube operatively positioned in axially alignment with the receiver. The first end of the burn tube may be operatively supported by an end of the receiver. The second end of the burn tube may be operatively connected to the end cap. The burn tube may be disposed within the internal portion of the tubular burn chamber. The burn tube may include an internal bore wall defining a bore for receiving and transporting the projectile.

In this yet another embodiment, the assembly may also include a pre-processing chamber defined by a first inner wall surface portion of the tubular burn chamber and a first outer wall surface portion of the receiver. The pre-processing chamber may receive, through one or more openings in the bore wall of the receiver, a combustion gas produced by the firing of the projectile. The assembly may also include a first set of chambers comprising a first accelerating chamber in fluid communication with a first expanding burn chamber. The volume area of the first accelerating chamber may be less than a volume area of the pre-processing chamber such that the combustion gas flowing from the pre-processing chamber to the first accelerating chamber is accelerated by compression in the first accelerating chamber. The volume area of the first expanding burn chamber may be greater than the volume area of the first accelerating chamber such that the accelerated combustion gas flowing from the first accelerating chamber to the first expanded burn chamber is expanded in the first expanded burn chamber and burns with an intermixing of the combustion gas with oxygen. The first expanding burn chamber may include a rippled outer surface on the portion of the burn tube disposed in the first expanded burn chamber to facilitate intermixing of the oxygen with the combustion gas to enhance burning thereof. The assembly may also include a second set of chambers comprising a second accelerating chamber in fluid communication with a second expanding burn chamber. The second accelerating chamber may be in fluid communication with the first expanded burn chamber. The volume area of the second accelerating chamber may be less than a volume area of the first expanded burn chamber such that the burned combustion gas flowing from the first expanded burn chamber to the second accelerating chamber is accelerated by compression in the second accelerating chamber. The volume area of the second expanding burn chamber may be greater than the volume area of the second accelerating chamber such that the accelerated burned combustion gas flowing from the second accelerating chamber to the second expanded burn chamber is expanded in the second expanded burn chamber and further burns with an intermixing of the burned combustion gas with oxygen. The second expanding burn chamber may include a rippled outer surface on the portion of the burn tube disposed in the second expanded burn chamber to facilitate intermixing of the oxygen with the burned combustion gas to enhance burning thereof. The assembly may also include a cooling chamber in fluid communication with the second expanded burn chamber. The cooling chamber may include a spiral threaded profile in the inner wall surface portion of the tubular burn chamber disposed in the cooling chamber. The spiral threaded profile may cause the burning gas to spin to facilitate burning and cooling of the burned gas as the burned gas flows through the cooling chamber. The assembly may also include a slowing chamber in fluid communication with the cooling chamber. The slowing chamber may be configured to slow a flow rate of the cooled gas before the cooled gas flows through the plurality of gas vents in the end cap to the exterior of the flash suppressor assembly.

In another embodiment of the flash suppressor assembly, the gas vents may be angled so as to expel the cooled gas in a direction away from a line of sight of a shooter.

In another embodiment of the flash suppressor assembly, the assembly may further comprise an insulating sleeve disposed between the outer sleeve and the tubular burn chamber. The insulating sleeve may include a first end operatively positioned on the base cap and a second end operatively positioned on the end cap.

The disclosure also is directed to an embodiment of a method of suppressing a flash from a fired weapon. The method may comprise the steps of providing a flash suppressor assembly as described hereinabove. The method may further include the step of affixing the receiver to the barrel muzzle. The method may further include step of causing the weapon to fire a projectile that produces combustion gas. The method may further include the step of directing the flow of the combustion gas from the bore of the receiver, through the openings in the bore wall of the receiver, to the first chamber. The method may further include the step of directing the flow of the combustion gas from the first chamber to the second chamber where the combustion gas is accelerated. The method may further include the step of directing the flow of the accelerated combustion gas to the third chamber where the accelerated combustion gas is mixed with oxygen to cause an enhanced burning of the combustion gas. The method may further include the step of directing the flow of the enhanced burning combustion gas from the third chamber to the fourth chamber where the enhanced burning combustion gas is caused to spin as it travels through the fourth chamber to cool the burning gas. The method may further include the step of expelling the cooled gas from the second end of the housing through the plurality of gas vents.

In another embodiment of the method, the outer wall section of the burn tube includes a plurality of grooves that facilitate the intermixing of the oxygen with the combustion gas to promote burning.

In another embodiment of the method, the flash suppressor assembly may further comprise a fifth chamber defined by a fifth inner wall surface portion of the tubular burn chamber and an end portion of the third outer wall section of the burn tube. The method may further comprise the step of directing the cooled gas from the fourth chamber to the fifth chamber where the flow of the cooled gas is slowed before being expelled through the plurality of gas vents to the exterior of the flash suppressor assembly.

DETAILED DESCRIPTION OF THE DISCLOSURE

A more complete understanding of the disclosure will be had by referring to the following description and claims of preferred embodiments, taken in conjunction with the accompanying drawings, wherein like reference numbers refer to similar parts throughout the several views.

Figure 1:
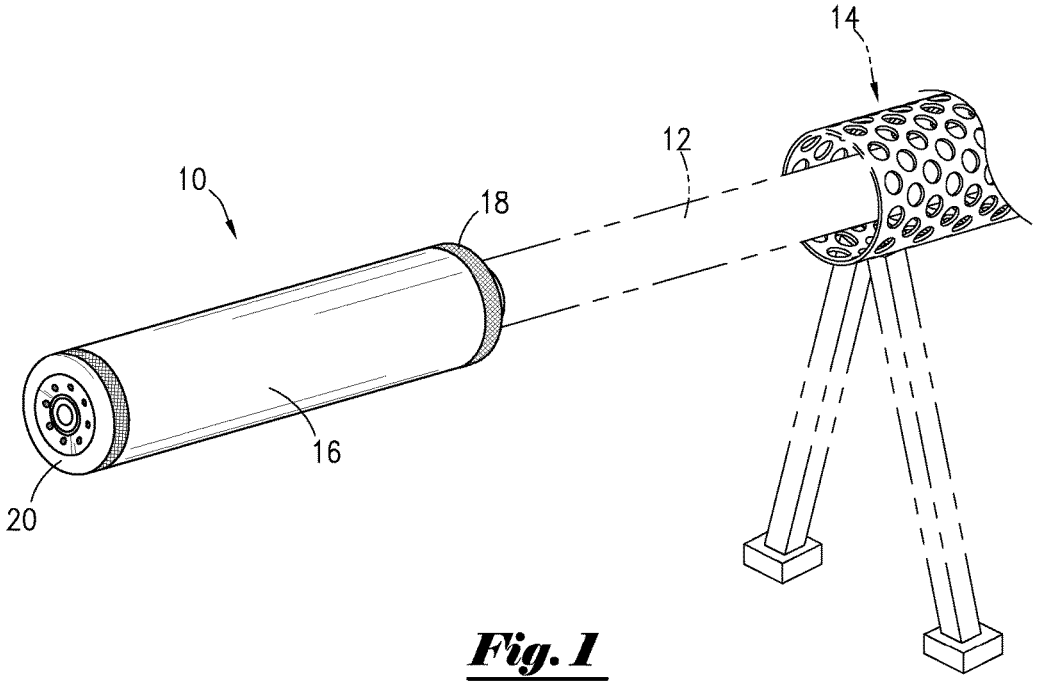
FIG. 1 is a perspective view of an embodiment of the flash suppressor assembly operatively positioned on the barrel muzzle of a weapon.

FIG. 1 depicts flash suppressor assembly 10 operatively positioned on the muzzle of barrel 12 of weapon 14. Weapon 14 may be any type of firearm for which flash suppression is desired. For example, weapon 14 may be any firearm that uses ammunition wherein the projectile is fired by ignition of a propellant. As a further example, weapon 14 may be a rifle.

Figure 2:
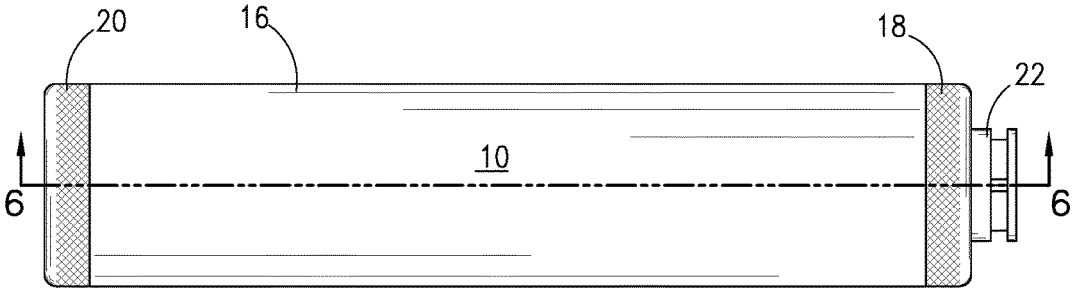
FIG. 2 is a side view of the embodiment of the flash suppressor assembly.

As seen in FIGS. 1 and 2, flash suppressor assembly 10 may include outer sleeve 16. One end of outer sleeve 16 is operatively connected to base cap 18. The other end of outer sleeve 16 is operatively connected to end cap 20. Operative connection of base cap 18, end cap 20, and outer sleeve 16 may provide the outer structural housing to contain internal components of flash suppressor assembly 10 that will be described hereinbelow.

With reference to FIG. 2, flash suppressor assembly 10 may include receiver 22 operatively positioned within and extending through base cap 18. Receiver 22 may provide the fixation point or area for operative connection of flash suppressor assembly 10 to the muzzle of barrel 12.

Figure 3:
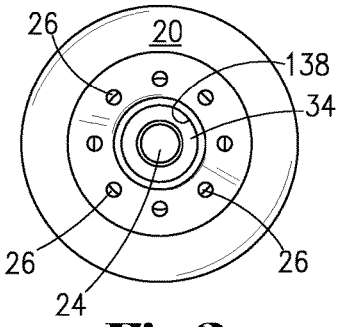
FIG. 3 is a front view of the embodiment of the flash suppressor assembly.
Figure 12:
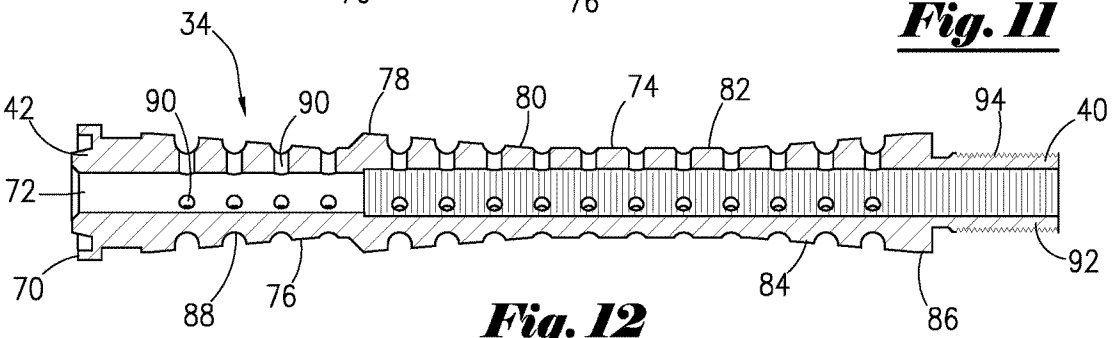
FIG. 12 is a cross-sectional view of the embodiment of the burn tube component taken along lines 12-12 of FIG. 11.

FIG. 3 illustrates end cap 20 with bore wall 138 within which end 40 of burn tube 34 is positioned. End cap 20 may also contain one or more gas vents 26 for the expulsion of combustion gases passing through flash suppressor assembly 10 when a projectile is fired by weapon 14. The number of gas vents 26 may varying depending on the volume of gas desired to be expelled from flash suppressor assembly 10. For example, the number of gas vents 26 may range from 2-10 or 4-8. In one embodiment, end cap 20 contains eight gas vents 26. Gas vents 26 may be spaced equidistantly apart. Gas vents 26 may be positioned circumferentially around projectile exit bore 24 as shown in FIG. 3 (exit bore 24 is defined by bore wall 72 of burn tube 34 as seen in FIG. 12 through which a projectile may exit from flash suppressor assembly 10 after being fired by weapon 14). Gas vents 26 may be spatially positioned so as to direct any flash exiting the end cap 20 away from the light of sight of the shooter so as not to interfere with the shooter's vision.

Figure 4:
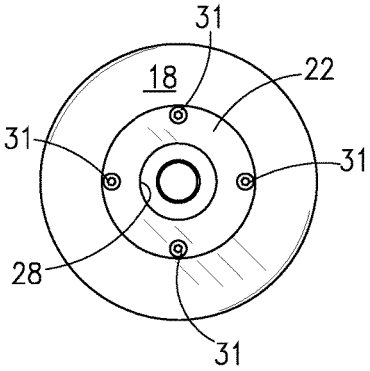
FIG. 4 is a back view of the embodiment of the flash suppressor assembly.

As seen in FIG. 4, base cap 18 is shown positioned about receiver 22. Receiver 22 may include muzzle bore 28. Muzzle bore 28 may accommodate and receive in operative connection the muzzle of barrel 12 of weapon 14. Receiver 22 may include one or more apertures 29 for placement of locking pins 31. As shown in FIG. 4, four apertures 29 are spaced apart equidistantly on receiver 22 and each contain a locking pin 31 with a spring 33 positioned behind and operatively arranged about the end of each locking pins 31 (see FIG. 5). Locking pins 31 and accompanying springs 33 keep base cap 18 and attached components from backing off receiver 22 during operation.

Figure 5:
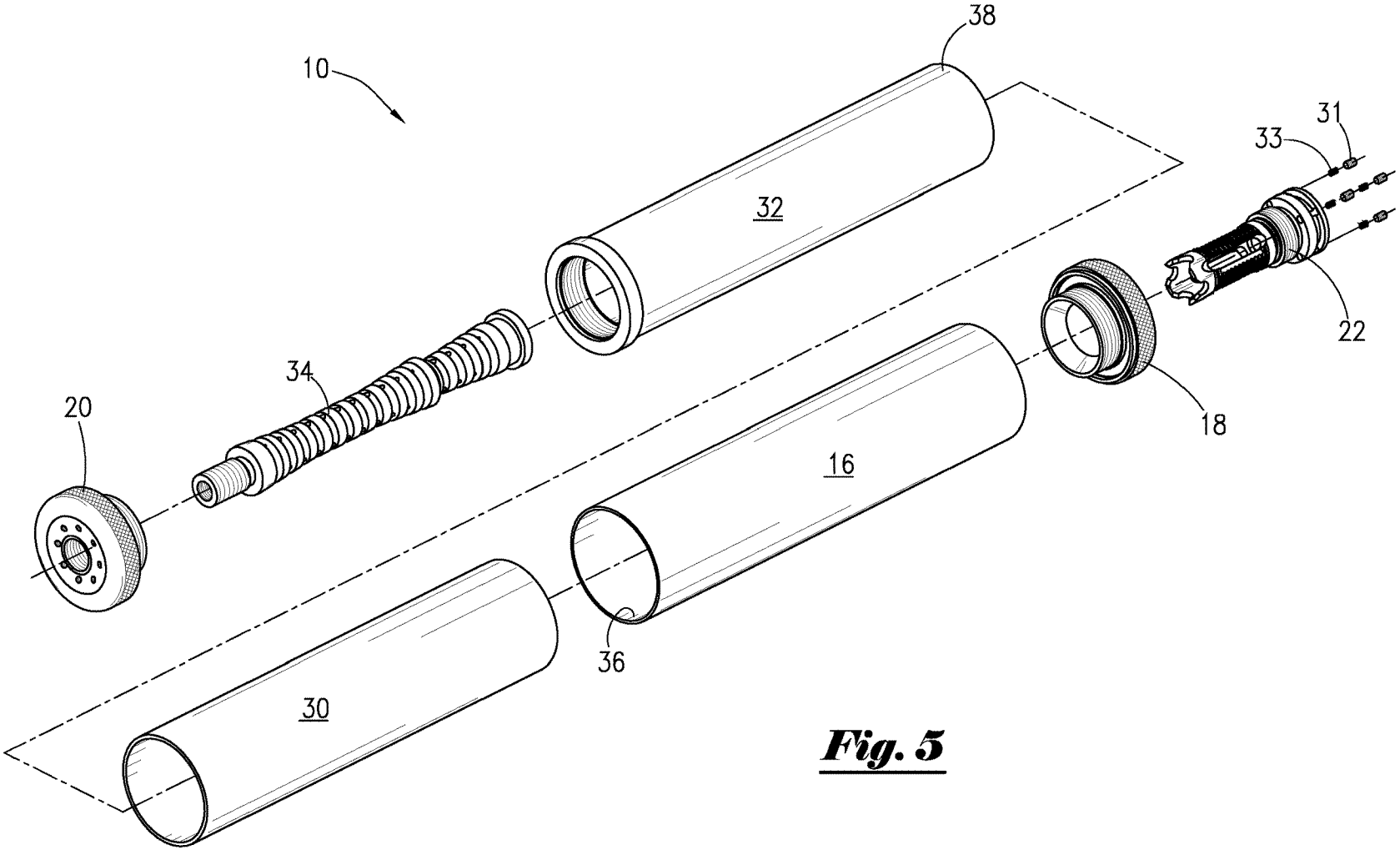
FIG. 5 is an exploded view of the embodiment of the flash suppressor assembly.

FIG. 5 reveals the internal components of flash suppressor assembly 10, which may include insulating sleeve 30, tubular burn chamber 32, and burn tube 34. Insulating sleeve 30 may be positioned within and directly adjacent to outer sleeve 16. Tubular burn chamber 32 may be positioned within and directly adjacent to insulting sleeve 30. Burn tube 34 may be positioned within tubular burn chamber 32.

Insulating sleeve 30 may be a separate component as shown in FIG. 5. Alternatively, insulting sleeve 30 may be made integral with internal wall 36 of outer sleeve 16 and/or integral with outer wall 38 of inner sleeve 32. Insulating sleeve 30 may be made of any material capable of containing or directing heat produced by combustible gases internally within flash suppressor assembly 10. Examples of such insulating materials include insulation blankets, as for example, AR50 gell blanket insulation. Alternatively, flash suppressor assembly 10 may be configured without insulting sleeve 30.

Figure 6:
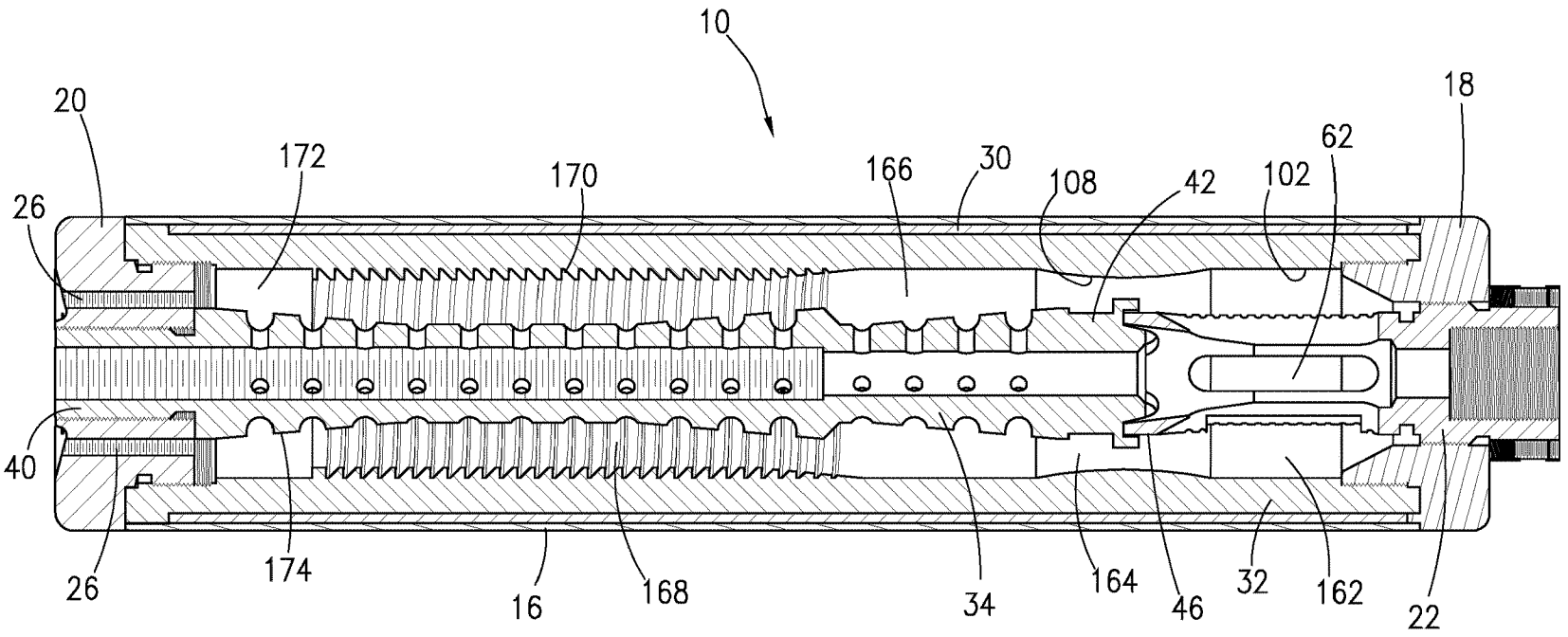
FIG. 6 is a cross-sectional view of the embodiment of the flash suppressor assembly taken along lines 6-6 of FIG. 2.

FIG. 6 depicts flash suppressor assembly 10 as operatively assembled. Placement of base cap 18 and end cap 20 at the respective ends of outer sleeve 16, insulting sleeve 30 and tubular burn chamber 32 detachably secures these components relative to one another. First end 40 of burn tube 34 is detachably connected to end cap 20. Second end 42 of burn tube 34 is supported by ends 46 of retainer 22. Contiguous connection of retainer 22 and burn tube 34 provides a pathway for the projectile fired by weapon 14 through flash suppressor assembly 10.

Figure 7:
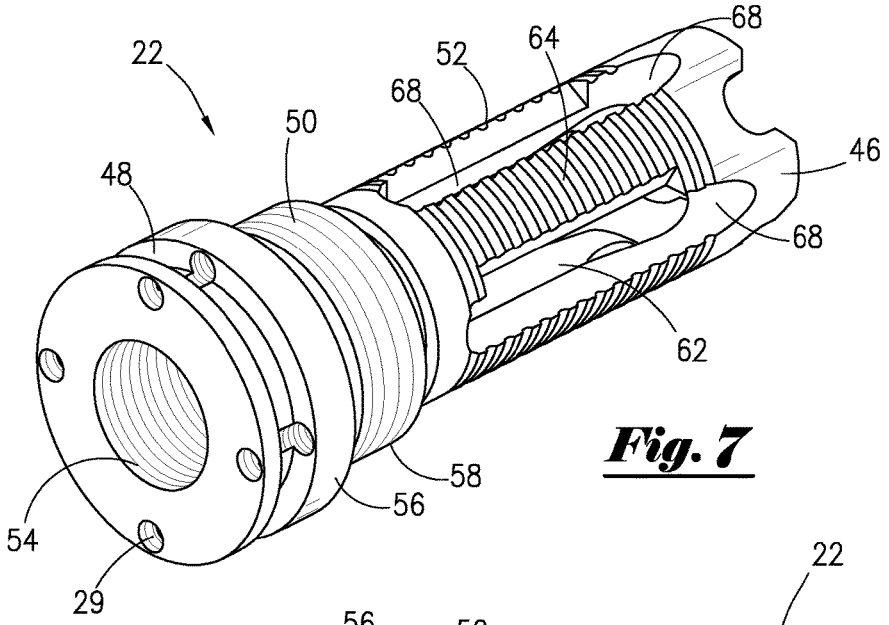
FIG. 7 is a perspective view of an embodiment of a receiver component.
Figure 8:
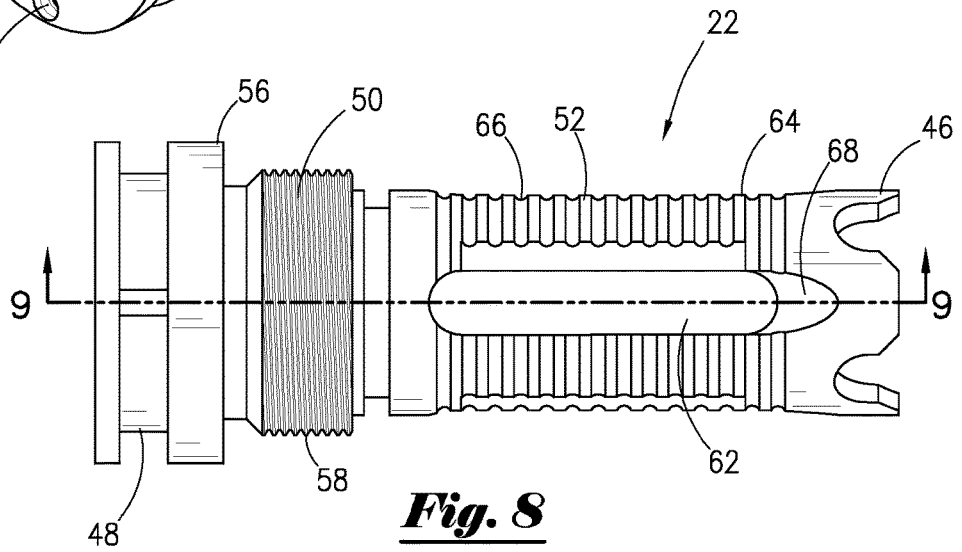
FIG. 8 is a side view of the embodiment of the receiver component.
Figure 9:
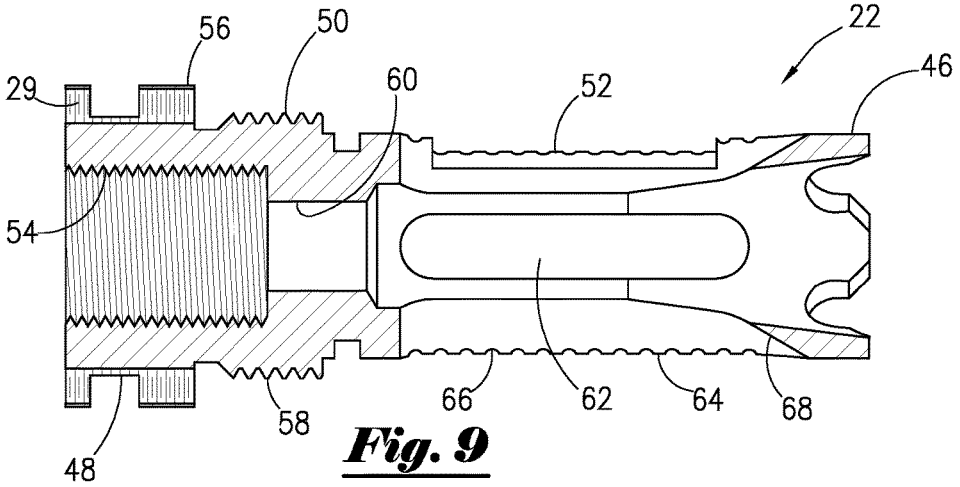
FIG. 9 is a cross-sectional view of the embodiment of the receiver component taken along lines 9-9 of FIG. 8.

With reference to FIGS. 7-9, retainer 22 may include muzzle connection section 48, base cap connection section 50, and longitudinally extending side wall section 52. Muzzle connection section 50 may include an enlarged diameter bore wall 54 for operative placement and retention of the muzzle of barrel 12. The muzzle of barrel 12 may be operative affixed within bore wall 54 by any suitable means to maintain flash suppressor assembly 10 on the muzzle. For example, bore wall 54 may contain threads that mate with cooperating threads on the outer diameter of the muzzle (not shown). In this configuration, flash suppressor assembly 10 is threadedly connected to the muzzle.

Again with reference to FIGS. 7-9, muzzle connection section 48 may include flange 56 that abuts against base cap 18 when receiver 22 is operatively connected to base cap 18. Base cap connection section 50 may include an outer surface 58. Outer surface 58 may contain means to detachably secure receiver 22 to base cap 18. For example, outer surface 58 may contain threads that mate with cooperating threads within base cap 18. In this configuration, receiver 22 is threadedly connected to base cap 18.

FIGS. 7-9 also shows that bore wall 54 terminates at reduced diameter bore wall 60 that extends axially through receiver 22. Bore wall 60 is dimensioned to receive the projectile fired by weapon 14 and thereby provide a pathway for the projectile as it travels through receiver 22. Bore wall 60 may contain a threaded profile to provide a vortex that centers the projectile as it travels through bore wall 60. Side wall section 52 may contain one or more openings 62 that permit combustion gases within bore wall 60 to pass through openings 62 to exterior of receiver 18. Side wall section 52 may include any number of openings 62 sufficient to transfer the combustion gases to the exterior of receiver 22. For example, the number of openings 62 in side wall section 62 may be in the range of 2-6, or 2-4, or 4. Outer surface 64 of side wall section 62 may include a wave profile providing a series of undulations. The wave profile may be configured as a series of U-shaped grooves 66. Grooves 66 may extend partially or completely along outer surface 64 and terminate at end 46. Grooves 66 function to disrupt the combustion gases to promote mixing with oxygen to facilitate burn while in the flash suppressor assembly 10 and thereby reduce or eliminate the flash that exits flash suppressor assembly 10.

With reference again to FIGS. 7-9, openings 62 terminate at tapered sections 68. Tapered sections 68 facilitate the expulsion of the combustion gases from openings 62 in a direction towards burn tube 34. As previously mentioned, ends 46 provide support for burn tube 34 and thereby operatively position burn tube within the interior of flash suppressor assembly 10.

Figure 10:
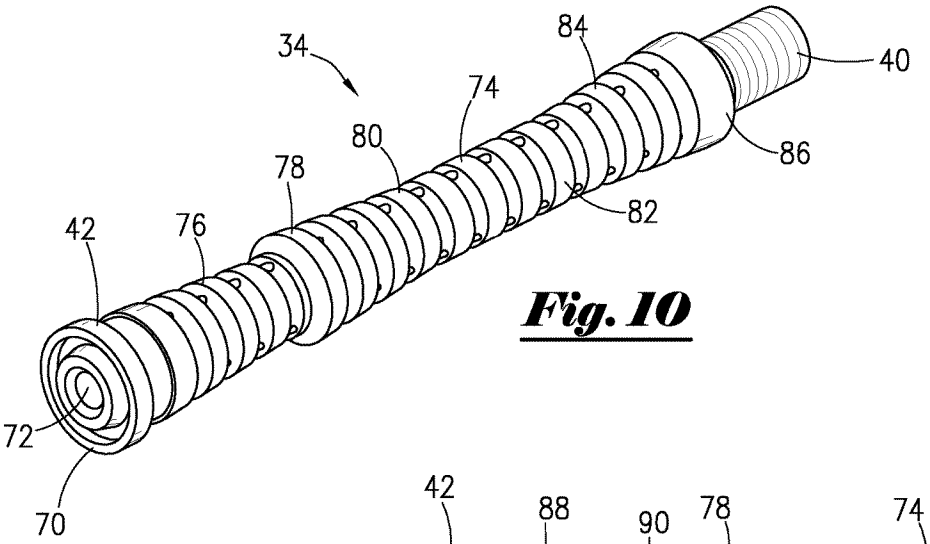
FIG. 10 is a perspective view of an embodiment of the burn tube component.
Figure 11:
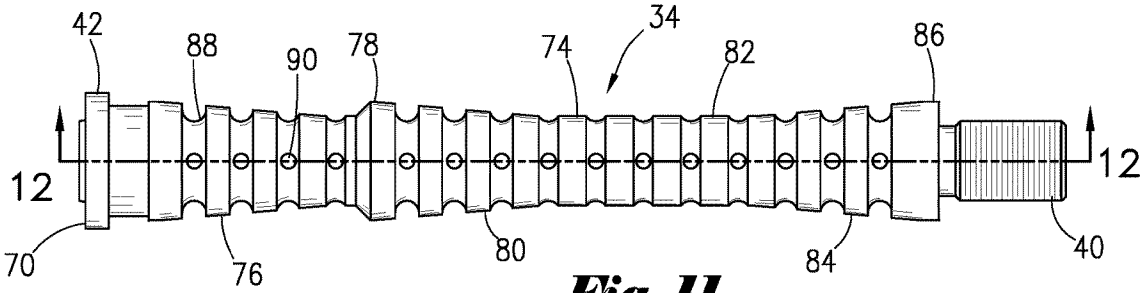
FIG. 11 is a side view of the embodiment of the burn tube component.

FIGS. 10-12 depict burn tube 34. End 42 may contain lip 70 that contains end 46 of receiver 18. Burn tube 34 may include bore wall 72 that longitudinally extends through the burn tube 34 and provides a pathway for the projectile as its travels through flash suppressor assembly 10. Bore wall 72 may contain a threaded profile to provide a vortex that centers the projectile as it travels through bore wall 72. Burn tube 34 may include an outer surface 74 that defines three sections: tapered first section 76 that extends from end 42 and terminates at enlarged diameter point 78; tapered second section 80 that extends from enlarged diameter point 78 and terminates at reduced diameter point 82; and tapered third section 84 that extends from reduced diameter point 82 and terminates at second enlarged diameter point 86, which is adjacent to end 40.

With reference to FIGS. 10-12, tapered first section 76 may have an outer diameter that tapers from an enlarged outer diameter to a reduced outer diameter as tapered first section 76 extends from end 42 to enlarged diameter point 78. Tapered second section 80 may have an outer diameter that tapers from an enlarged outer diameter to a reduced outer diameter as tapered second section extends from enlarged diameter point 78 to reduced diameter point 82. Tapered third section 84 may have an outer diameter that tapers from a reduced outer diameter to an enlarged outer diameter as tapered third section 84 extends from reduced diameter point 82 to second enlarged diameter point 86.

Again with reference to FIGS. 10-12, outer surface 74 of burn tube 34 may be partially or completely profiled so as to produce a rippling effect as combustion gases pass over the outer surface 74. For example, outer surface 74 may be configured in a wave-form profile or undulations. The wave-form profile may be provided as a series of U-shaped grooves 88. One or all of tapered first, second, and third sections 76, 80, 84 may contain grooves 88. Each of tapered first, second and third sections 76, 80, 84 may partially or completely contain grooves 88. Grooves 88 function to disrupt and mix the hot gases traveling over outer surface 74 to facilitate the burning of the gases within the flash suppressor assembly 10.

FIGS. 10-12 also reveal that burn tube 34 may contain one or more apertures 90 providing for fluid communication from the bore wall 72 to the exterior of burn tube 34. Fluid (such as air (e.g., oxygen)) within the bore formed by bore wall 72 may exit the bore as the projectile passes through the bore. The fluid thereafter may mix with the combustion gases to facilitate the burning of the gases. The number of apertures 90 provided in burn tube 34 may vary depending on the length and dimensions of the burn tube. For example, an aperture 90 may be positioned in each groove 88.

As also seen in FIGS. 10-12, burn tube 34 terminates at end 40. End 40 may include end cap connecting section 92 dimensioned for connection to end cap 20. Section 92 may contain an outer surface 94. Outer surface 94 may be provide with means for connecting section 92 to end cap 20. For example, outer surface 94 may contain threads that mate with cooperating threads on end cap 20.

FIG. 12 shows that bore wall 72 from lip 70 through to point 78 may be smoothed walled and from point 78 extending through to end 40 may contain a contiguous spiral thread that provides a vortex that centers the projectile as it travels through bore wall 72.

Figure 13:
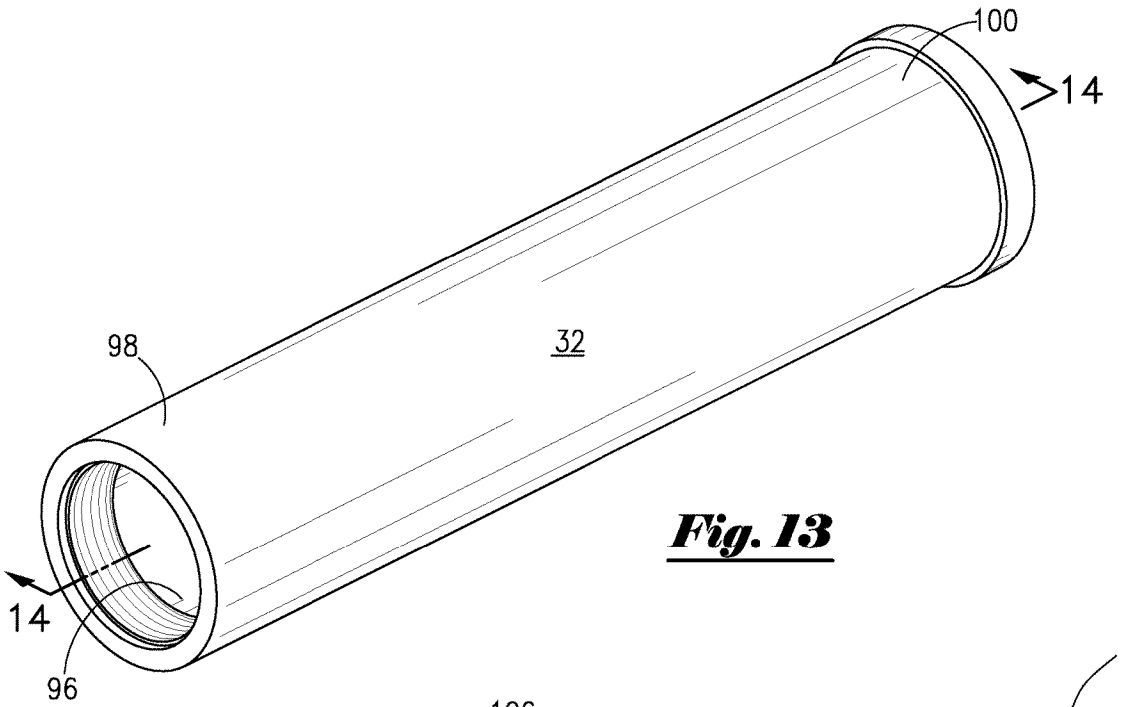
FIG. 13 is a perspective view of an embodiment of the tubular burn chamber component.
Figure 14:
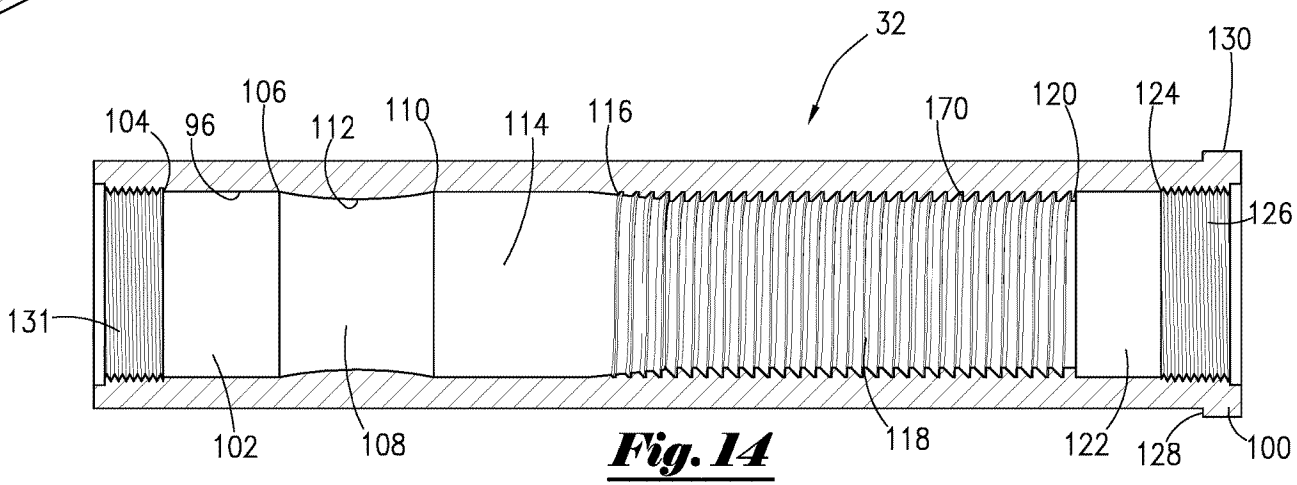
FIG. 14 is a cross-sectional view of the embodiment of the tubular burn chamber component taken along lines 14-14 of FIG. 13.

FIGS. 13 and 14 illustrate tubular burn chamber 32. Tubular burn chamber 32 may be a tubular with internal bore wall 96. First end 98 of tubular burn chamber 32 may detachably connect with base cap 18. First end 98 may contain means that provide for detachable connection to base cap 18. For example, bore wall 96 at first end 98 may contain threads that mate with cooperating threads on base cap 18. Second end 100 of tubular burn chamber 32 may be detachably connected to end cap 20. Second end 100 may contain means that provide for detachable connection to end cap 20. For example, bore wall 98 at second end 100 may contain threads that mate with cooperating threads on end cap 20.

As shown in FIG. 14, bore wall 96 may be profiled to define sections having different internal diameters. First section 102 may have a first internal diameter profile starting at point 104 and terminating at point 106. First internal diameter profile may be constant. Second section 108 may have a second internal diameter profile staring at point 106 and terminating at point 110. Second internal diameter profile may decrease in a tapered fashion from point 106 to apex 112 and thereafter increase until point 110. Thus, second section 108 has an internal diameter at apex 112 that is reduced in relation to the internal diameter of section 102. Third section 114 may have a third internal diameter profile starting at point 110 and terminating at point 116. Third internal diameter profile may enlarge from point 110 until point 116 providing for an enlarged internal diameter in relation to the internal diameter of second section 108. The length of third section 114 may be greater than the length of second section 112. The length of second section 112 may be greater than the length of first section 102.

Again with reference to FIG. 14, bore wall 96 may be profiled to include fourth section 118. Fourth section 118 may have a fourth internal diameter profile starting at point 116 and terminating at point 120. Fourth internal diameter profile may be constant with an internal diameter equal to or slightly less than the internal diameter of third section 114. Fourth internal diameter profile may be partially or completely configured in a threaded pattern. The threaded pattern may constitute a spiral thread contiguously configured in section 118. The length of fourth section 118 may vary depending on the length of third section 114. For example, the length of fourth section 118 may be the same as the length of third section 114 or it may be longer than third section 114. For example, fourth section 118 may be about twice the length of third section 114. The length of fourth section 118 may be about the same of the combined length of first, second, and third sections 102, 108, 114.

With further reference to FIG. 14, bore wall 96 may be profiled to include fifth section 122. Fifth section 122 may have a fifth internal diameter profile staring at point 120 and terminating at point 124. Fifth internal diameter profile may have an internal diameter that is constant. The internal diameter of the fifth section 122 may be the same as the internal diameter of first section 102. Bore wall 96 also may contain means for connecting end 100 to end cap 20. For example, bore wall 96 may be profiled with threaded section 126 containing threads that mate with cooperating threads in end cap 20. Tubular burn chamber 32 may also include shoulder 128 at end 100 that receives and supports an end of insulating sleeve 30 when assembled with flash suppressor assembly 10. Tubular burn chamber 32 may also include face 130 that receives and supports an end of outer sleeve 16 when flash suppressor assembly 10 is assembled.

Figure 15:
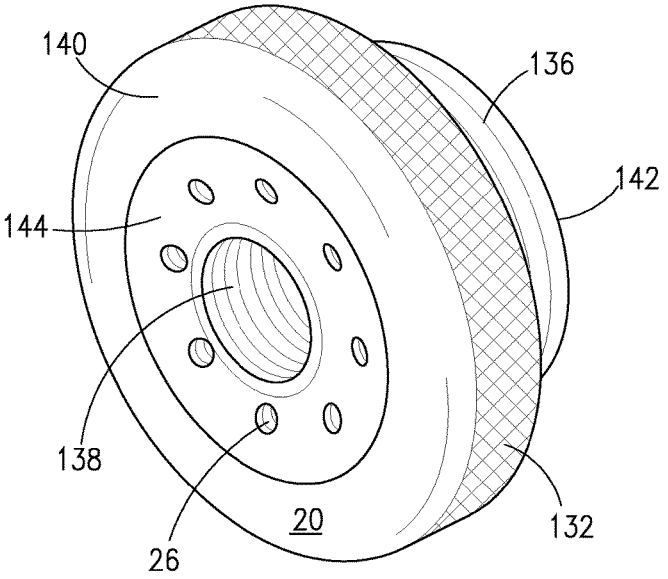
FIG. 15 is a perspective view of an embodiment of end cap component.
Figure 17:
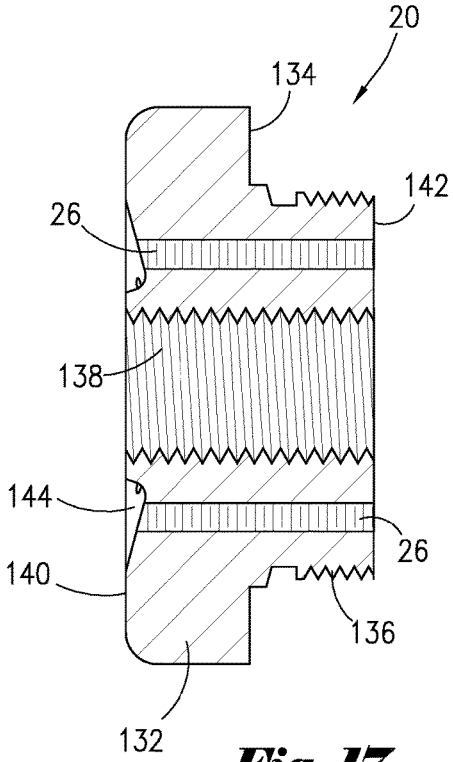
FIG. 17 is a cross-sectional view of the embodiment of the end cap component taken along lines 17-17 of FIG. 16.
Figure 16:
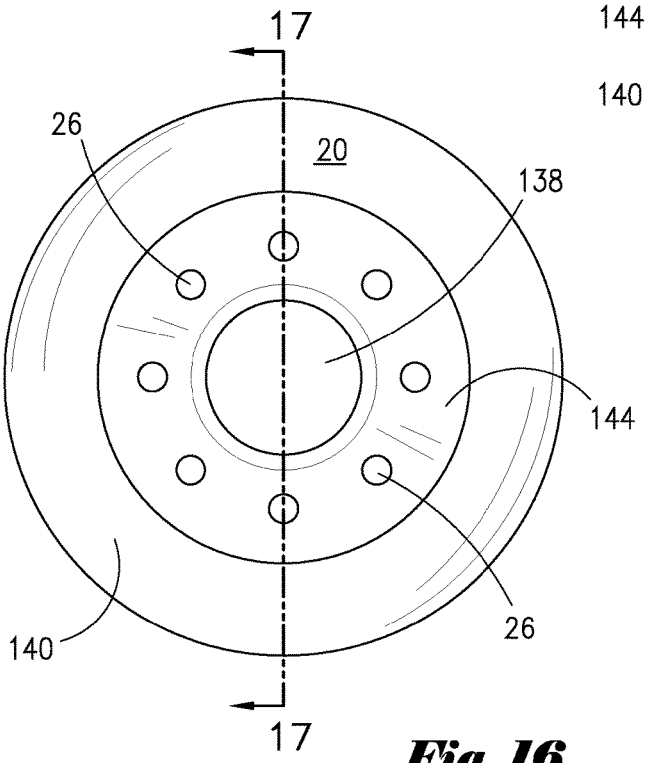
FIG. 16 is a front view of the embodiment of the end cap component.

FIGS. 15-17 show end cap 20. End cap 20 may contain flanged section 132 with shoulder 134 that receives and supports the end of outer sleeve 16 and the end of tubular burn chamber 32 when flash suppressor assembly 10 is assembled. End cap 20 also may contain tubular burn chamber connecting section 136 that may include connecting means. The connecting means may include threads that mate with cooperating threads of threaded section 126 of tubular burn chamber 32. End cap 20 may include bore wall 138 that receives end 40 of burn tube 34. Bore wall 138 may detachably connect to end 40 of burn tube 34. For example, bore wall 18 may contain threads that mate with cooperating threads on end 40 of burn tube 34. End cap 20 is also shown with gas vents 26 extending from front face 140 to back face 142. Where gas vents 26 exit from front face 140, end cap 20 is provided with directional inserts 144 angling front face 140 so as to direct the expulsion of any flash from gas vents 26 in a direction way from the line of sight of the shooter.

Figure 18:
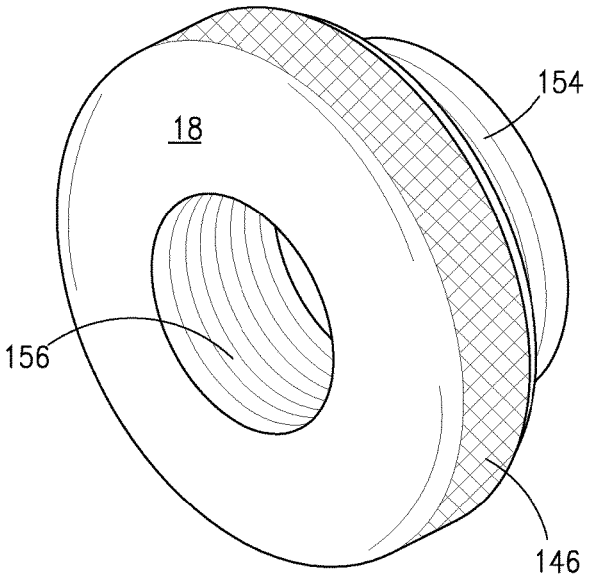
FIG. 18 is a perspective view of an embodiment of the base cap component.
Figure 20:
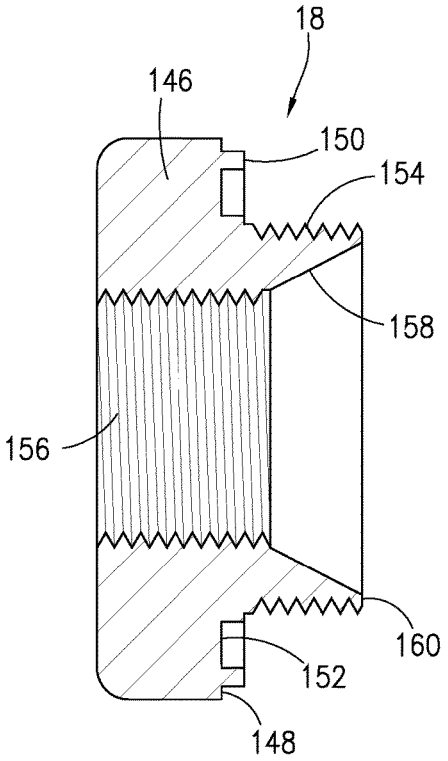
FIG. 20 is a cross-sectional view of the embodiment of the base cap component taken along lines 20-20 of FIG. 19.
Figure 19:
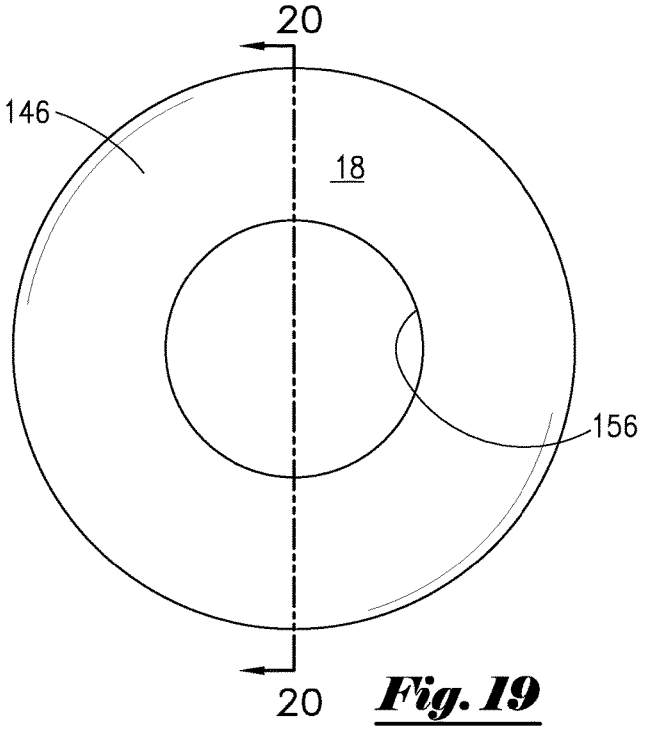
FIG. 19 is a front view of the embodiment of the base cap component.

FIGS. 18-20 depict base cap 18. Base cap 18 may have flange section 146 with shoulder 148, face 150, and lip 152. Shoulder 148 receives and supports the end of outer sleeve 16 when flash suppressor assembly 10 is assembled. Face 152 receives and supports the end of insulting sleeve 30 when flash suppressor assembly 10 is assembled. Lip 150 receives and supports the end of tubular burn chamber 32 when flash suppressor assembly 10 is assembled. Base cap 18 may also contain tubular burn chamber connecting section 154 that may include means to detachably connect base cap 18 to tubular burn chamber 32. For example, tubular burn chamber connecting section 154 may include threads that mate with cooperating threads of threaded section 131 of tubular burn chamber 32.

As also seen in FIGS. 18-20, base cap 18 may include bore wall section 156 that may contain means for detachably connecting receiver 22. For example, bore wall section 156 may include threads that mate with cooperating threads on outer surface 58 of receiver 22. Bore wall section 156 may include tapered section 158 that terminates at end face 160. Tapered section 158 may provide a means to direct combustion gases exiting receiver 22 in a direction downward towards burn tube 34.

In operation, flash suppressor assembly 10 is detachably secured to the muzzle of barrel 12 of weapon 14. A shooter fires weapon 14 causing the projectile in the chamber to be expelled into barrel 12 and travel from barrel 12 into flash suppressor assembly 10. The projectile may be a cartridge consisting of a bullet housed in a case. Propellant such as gunpowder, cordite or other explosive and combustible material may be contained in the case behind the bullet. The cartridge may also contain a rim and primer at its actuation end. Actuating the primer by firing weapon 14 ignites the propellant that causes the firing of the bullet that travels through the barrel 12. The gases behind the bullet are combustible and may cause flash (unless suppressed) as the bullet exits the barrel 12.

With the flash suppressor assembly 10 in place on the muzzle, the bullet and hot gases are expelled into the receiver 22. The bullet will travel along the pathway provided by the contiguous bore walls of the receiver and burn tube 54, 72 until the bullet is expelled at the other end of the flash suppressor assembly 10. With the internal configuration of the flash suppressor assembly 10, the combustion gases entering receiver 22 will flow from the bore wall 54 through openings 62 and into first chamber defined by first section 102 of tubular burn chamber 32 and side wall section 52 of receiver 22. After being received in first chamber 162, the combustion gases flow to second chamber 164. Second chamber 164 is defined by second section 108 of tubular burn chamber 32 and part of side wall section 52 and end 42 of burn tube 34. Due to the tapered profile of second section 108 and the increased outer diameter area of end 42, chamber 164 has a reduced volume area in relation to chamber 162 that causes compression and acceleration of the combustion gas as it travels through second chamber 164 to third chamber 166. The third chamber 166 is defined by third section 114 of tubular burn chamber 32 and tapered first section 76 of burn tube 34. Due to the decreasing tapered profile of the outer diameter of tapered section 76 and the expanding profile of the inner diameter of the third section 114 of tubular burn chamber 34, the volume area contained within third chamber 166 is greater than the volume area of the second chamber 164. Accordingly, third chamber 166 is an expansion or burn chamber that permits the compressed/accelerated combustion gases flowing from second chamber 164 into third chamber 166 to expand, mix with oxygen, and burn. The wave-form or undulating profile of the outer surface 74 of burn tube 34 (e.g., grooves 88) acts to disrupt the gas and facilitate intermixing of the combustion gas with oxygen to advance the burning thereof. While the flash suppressor assembly 10 shown in FIG. 6 is an embodiment containing one compression chamber (chamber 164) and one expansion or burn chamber (chamber 166), it is to be understood that a series of compression and expansion/burn chambers could be provided. For example, flash suppressor assembly could contain two sets of the compression and expansion/burn chambers or more than two sets.

With reference to FIG. 6, flash suppressor assembly 10 may also include fourth chamber 168. Fourth chamber 168 is defined by fourth section 118 of tubular burn chamber 32 and tapered second and third sections 80, 84 of burn tube 34. Due to the decreasing tapering of tapered second section 80, burning gas in third chamber 166 flows into fourth chamber 168 around tapered second section 80 which initially acts to compress and then expand the gas as a result of the increasing volume area of chamber 168 from the tapered second section 80 to the tapered third section 84 of burn tube 34. Due to the increasing tapering of tapered section 84, gas flowing around tapered section 84 is compressed as it reaches point 86. The extended length of fourth chamber 168 results in an extended travel time as the burned gas flows through fourth chamber 168. This extended travel time provides time to complete the burning process and cooling of the burned gases. To facilitate the complete burning process within fourth chamber 168, fourth section 118 of tubular burn chamber 32 may include spiral threads 170 that act to spin the burning gases thereby promoting disbursement of oxygen throughout the combustion gases to increase the burning of the gases. The wave-form or undulating profile of outer surface 74 of tapered sections 80, 84 of burn tube 34 also contribute to the intermixing of oxygen with the combustion gases to facilitate of complete burn thereof. Fourth chamber 168 also provides for the slowing of the flow of the burned gases.

After the gases are burned and cooled within the fourth chamber 168, the burned/cooled gases flow into fifth chamber 172. Fifth chamber 172 is defined by fifth section 122 of tubular burn chamber 34 and end section 174 of tapered third section 84 of burn tube 34. Due to the increasing tapering of end section 174, the gases in fifth chamber 172 may be slightly compressed as they flow through fifth chamber 172. Fifth chamber 172 is configured to reduce the flow speed of the gases before they exit through gas vents 26 and are expelled into the atmosphere in a direction away from the shooter's line of sight.

The component parts constituting flash suppressor assembly 10 may be made of any heat durable material. For example, the component parts may be made from steel or other hard metal. The component parts may be composed of a composite material capable of withstanding combustion of the exhaust gases. Burn tube 34 may be composed of 4140 steel or titanium.

Flash suppressor assembly 10 may be sized in a variety of dimensions. For example, the outer diameter of flash suppressor assembly 10 may be about 2.25 inches. The length of flash suppressor assembly 10 may be in the range of 10-12 inches or about 10 inches.

Tubular burn chamber 32 may have an outer diameter in the range of about 2 inches and about 2.145 inches at face 130. The inner diameter of tubular burn chamber 32 may varying from about 1.5 inches to about 1.375 inches. For example, section 102 may have an inner diameter of about 1.5 inches, section 108 may have an inner diameter with a gradient or slope from about 1.5 inches to about 1.375 inches to about 1.5 inches, section 114 may have an inner diameter of about 1.5 inches, section 118 may have an inner diameter of about 1.5 inches, and section 122 may have an inner diameter of about 1.5 inches. Tubular burn chamber 32 may have an overall length of about 9.281 inches. Section 102 may have a length of about 1.5 inches, section 108 may have a length of about 1.250 inches, section 114 may have a length of about 1.250 inches, section 118 may have a length of about 4 inches, section 122 may have length of 1.25 inches.

Burn tube 34 may have a length of about 7.816 inches, an outer diameter in the range of 0.551 inches to 1.070 inches. Bore wall 72 may have diameter of 0.312 inches. Tapered first section 76 may have a length of about 2.109 inches with a gradient or slope from about 1.070 inches to about 0.645 inches. Tapered second section 80 may have a length of about 2.5 inches with a gradient or slope from about 0.938 inches to about 0.705 inches. Tapered third section 84 may have a length of about 2.5 inches with a gradient or slope from about 0.705 inches to about 0.938 inches. End 40 may have a length of about 1.0 inches and an outer diameter of about 0.551 inches. Grooves 88 may have a depth of about 0.625 inches or ⅝ inches and a width of about 3/16 inches. The dimensions of grooves 88 may varying within and/or between sections 76, 80 and 84. For example, the depth of grooves 88 in section 76 may gradually lessen as the grooves 88 progress to point 78. Similarly, the depth of grooves 88 in section 80 may gradually lessen as the grooves 88 progress from point 78 to point 82. The depth of grooves 88 in section 84 may gradually increase as the grooves progress from point 82 to point 86. The number and dimensions of grooves 88 control the timing of gas speed and create more turbulence in burn tube 34 to cool the gases. Grooves 88 disrupt the gas flow through burn tube 34 and slow down the forward movement of the gases in a delaying time ratio of about 3 to 1 by fluid volume. The smooth section of bore wall 72 may have a length of about 2.316 inches. The threaded section of bore wall 72 may have a length of about 5.50 inches.

Flash suppressor assembly 10 operates by providing receiver 22 that receives hot gases when a projectile is fired and distributes the hot gases to one or more sets of contracting/compression chambers and expansion/burning chambers with one or all of the chambers containing at least one rippled surface to permit the gases to intermix with oxygen to enhance burning. Optionally, a screw or spiraling chamber may be provided to circulate the hot gases to allow for complete burning in a spiraling fashion before the burned gases exit to the atmosphere through vents 26 in the end cap 20. Optionally, insulating sleeve 30 may be provided between outer sleeve 16 and tubular burn chamber 32 to keep the heat generated by the burning of the gases within the burn chambers to further enhance and promote the complete burning of the gases.

Although the foregoing disclosure has been described in some detail by way of illustration and example for purposes of clarity of understanding, it will be obvious that certain changes and modifications may be practiced within the scope of the appended claims.

What is claimed is:

1. A flash suppressor assembly comprising:

a housing including a first end and a second end, the housing including an internal space;

a tubular burn chamber disposed within the internal space of the housing, the tubular burn chamber having a first end operatively connected to the first end of the housing and a second end operatively connected to the second end of the housing, the tubular burn chamber including an internal portion;

a receiver detachably secured at the first end of the housing, the receiver configured for detachable fixation to a barrel muzzle, the receiver including an internal bore wall defining a bore for receiving and transporting a projectile fired by a weapon, the receiver extending into the internal portion of the tubular burn chamber;

a burn tube operatively positioned in axially alignment with the receiver, a first end of the burn tube operatively supported by an end of the receiver, a second end of the burn tube operatively connected to the second end of the housing, the burn tube disposed within the internal portion of the tubular burn chamber, the burn tube including an internal bore wall defining a bore for receiving and transporting the projectile;

a first chamber defined by a first inner wall surface portion of the tubular burn chamber and a first outer wall surface portion of the receiver, the first chamber receiving, through one or more openings in the bore wall of the receiver, a combustion gas produced by the firing of the projectile;

a second chamber defined by a second inner wall surface portion of the tubular burn chamber and a second outer wall surface portion of the receiver and a first portion of a first outer wall section of the burn tube, a volume of the second chamber being less than a volume of the first chamber such that the combustion gas flowing from the first chamber to the second chamber is accelerated by compression in the second chamber;

a third chamber defined by a third inner wall surface portion of the tubular burn chamber and a second portion of the first outer wall section of the burn tube, volume area of the third chamber being greater than the volume of the second chamber such that the accelerated combustion gas flowing from the second chamber to the third chamber is expanded in the third chamber and burns with an intermixing of the combustion gas with oxygen;

a fourth elongated chamber defined by a fourth inner wall surface portion of the tubular burn chamber and a second and third outer wall sections of the burn tube, the fourth inner wall surface being profiled with spiral threads, the spiral threads causing the burning gas to spin to facilitate burning and cooling of the burned gas as the burned gas flows through the fourth elongated chamber;

a plurality of gas vents disposed in the second end of the housing for transmission of the burned gas from the fourth elongated chamber to the exterior of the flash suppressor assembly.

2. The flash suppressor assembly of claim 1, wherein the first outer wall section of the burn tube includes a plurality of grooves that facilitate the intermixing of oxygen with the combustion gas to promote burning.

3. The flash suppressor assembly of claim 2, wherein the second and third outer wall sections of the burn tube include a plurality of grooves that facilitate the intermixing of oxygen with the combustion gas to promote burning.

4. The flash suppressor assembly of claim 1, wherein the first outer wall section of the burn tube has a decreasing tapered profile in the direction of the second end of the housing.

5. The flash suppressor assembly of claim 4, wherein the second outer wall section of the burn tube has a decreasing tapered profile in the direction of the second end of the housing.

6. The flash suppressor assembly of claim 5, wherein the third outer wall section of the burn tube has an increasing tapered profile in the direction of the second end of the housing.

7. The flash suppressor assembly of claim 1, wherein the second inner wall surface portion of the tubular burn chamber has a decreased inner diameter in relation to an inner diameter of the first inner wall portion of the tubular burn chamber.

8. The flash suppressor assembly of claim 7, wherein the third inner wall surface portion of the tubular burn chamber has an increased inner diameter in relation to the decreased inner diameter of the second inner wall portion of the tubular burn chamber.

9. The flash suppressor assembly of claim 1, further comprising a fifth chamber defined by a fifth inner wall surface portion of the tubular burn chamber and an end portion of the third outer wall section of the burn tube, the fifth chamber receiving and slowing the transmission of the burned and cooled gas from the fourth chamber and transmitting the slowed burned and cooled gas through the plurality of gas vents to the exterior of the flash suppressor assembly.

10. The flash suppressor assembly of claim 1, wherein the housing includes an outer sleeve having a first end and a second end, a base cap, and an end cap, wherein the first end of the outer sleeve is operatively connected to the base cap and the second end of the outer sleeve is operatively connected to the end cap, and wherein the first end of the tubular burn chamber is operatively connected to the base cap and the second end of the tubular burn chamber is operative connected to the end cap.

11. The flash suppressor assembly of claim 10, further comprising an insulating sleeve disposed between the outer sleeve and the tubular burn chamber, the insulating sleeve includes a first end operatively positioned on the base cap and a second end operatively positioned on the end cap.

12. The flash suppressor assembly of claim 10, wherein the base cap includes a tapered surface for directional movement of the combustion gas in the direction towards the end cap.

13. The flash suppressor assembly of claim 1, wherein the receiver includes an enlarged diameter section for detachable connection to the barrel muzzle and a side wall section, the side wall section containing the openings from the bore wall.

14. The flash suppressor assembly of claim 13, wherein the side wall section of the receiver terminates at an end tip and wherein the first end of the burn tube contains a lip, wherein the end tip of the side wall section of the receiver is received into the lip of the first end of the burn tube to thereby support the burn tube in axial alignment with the receiver.

15. A flash suppressor assembly comprising:

a housing including an outer sleeve having a first end and a second end, a base cap, and an end cap, wherein the first end of the outer sleeve is operatively connected to the base cap and the second end of the outer sleeve is operatively connected to the end cap, the end cap including a plurality of gas vents, the housing including an internal space;

a tubular burn chamber disposed within the internal space of the housing, the tubular burn chamber having a first end operatively connected to the base cap and a second end operatively connected to the end cap, the tubular burn chamber including an internal portion;

a receiver detachably secured to the base cap, the receiver configured for detachable fixation to a barrel muzzle, the receiver including an internal bore wall defining a bore for receiving and transporting a projectile fired by a weapon, the receiver extending into the internal portion of the tubular burn chamber;

a burn tube operatively positioned in axially alignment with the receiver, a first end of the burn tube operatively supported by an end of the receiver, a second end of the burn tube operatively connected to the end cap, the burn tube disposed within the internal portion of the tubular burn chamber, the burn tube including an internal bore wall defining a bore for receiving and transporting the projectile;

a pre-processing chamber defined by a first inner wall surface portion of the tubular burn chamber and a first outer wall surface portion of the receiver, the pre-processing chamber receiving, through one or more openings in the bore wall of the receiver, a combustion gas produced by the firing of the projectile;

a first set of chambers comprising an accelerating chamber in fluid communication with an expanding burn chamber, a volume of the accelerating chamber being less than a volume of the pre-processing chamber such that the combustion gas flowing from the pre-processing chamber to the accelerating chamber is accelerated by compression in the accelerating chamber, a volume of the expanding burn chamber being greater than the volume of the accelerating chamber such that the accelerated combustion gas flowing from the accelerating chamber to the expanding burn chamber is expanded in the expanding burn chamber and burns with an intermixing of the combustion gas with oxygen, the expanding burn chamber including a rippled outer surface on the portion of the burn tube disposed in the expanding burn chamber to facilitate intermixing of the oxygen with the combustion gas to enhance burning thereof;

a cooling chamber in fluid communication with the expanding burn chamber, the cooling chamber including a spiral threaded profile in the inner wall surface portion of the tubular burn chamber disposed in the cooling chamber, the spiral threaded profile causing the burning gas to spin to facilitate burning and cooling of the burned gas as the burned gas flows through the cooling chamber;

a slowing chamber in fluid communication with the cooling chamber, the slowing chamber configured to slow a flow rate of the cooled gas before the cooled gas flows through the plurality of gas vents in the end cap to the exterior of the flash suppressor assembly.

16. The flash suppressor assembly of claim 15, wherein the gas vents are angled so as to expel the cooled gas in a direction away from a line of sight of a shooter.

17. The flash suppressor assembly of claim 15, further comprising an insulating sleeve disposed between the outer sleeve and the tubular burn chamber, the insulating sleeve includes a first end operatively positioned on the base cap and a second end operatively positioned on the end cap.

18. A method of suppressing a flash from a fired weapon comprising the steps of:

a) providing a flash suppressor assembly comprising: a housing including a first end and a second end, the housing including an internal space; a tubular burn chamber disposed within the internal space of the housing, the tubular burn chamber having a first end operatively connected to the first end of the housing and a second end operatively connected to the second end of the housing, the tubular burn chamber including an internal portion; a receiver detachably secured at the first end of the housing, the receiver configured for detachable fixation to a barrel muzzle, the receiver including an internal bore wall defining a bore for receiving and transporting a projectile fired by a weapon, the receiver extending into the internal portion of the tubular burn chamber; a burn tube operatively positioned in axially alignment with the receiver, a first end of the burn tube operatively supported by an end of the receiver, a second end of the burn tube operatively connected to the second end of the housing, the burn tube disposed within the internal portion of the tubular burn chamber, the burn tube including an internal bore wall defining a bore for receiving and transporting the projectile; a first chamber defined by a first inner wall surface portion of the tubular burn chamber and a first outer wall surface portion of the receiver, the first chamber receiving, through one or more openings in the bore wall of the receiver, a combustion gas produced by the firing of the projectile; a second chamber defined by a second inner wall surface portion of the tubular burn chamber and a second outer wall surface portion of the receiver and a first portion of a first outer wall section of the burn tube, a volume of the second chamber being less than a volume of the first chamber such that the combustion gas flowing from the first chamber to the second chamber is accelerated by compression in the second chamber; a third chamber defined by a third inner wall surface portion of the tubular burn chamber and a second portion of the first outer wall section of the burn tube, a volume of the third chamber being greater than the volume of the second chamber such that the accelerated combustion gas flowing from the second chamber to the third chamber is expanded in the third chamber and burns with an intermixing of the combustion gas with oxygen; a fourth elongated chamber defined by a fourth inner wall surface portion of the tubular burn chamber and a second and third outer wall sections of the burn tube, the fourth inner wall surface being profiled with spiral threads, the spiral threads causing the burning gas to spin to facilitate burning and cooling of the burned gas as the burned gas flows through the fourth elongated chamber; a plurality of gas vents disposed in the second end of the housing for transmission of the burned gas from the fourth elongated chamber to the exterior of the flash suppressor assembly;

b) affixing the receiver to the barrel muzzle;

c) causing the weapon to fire a projectile that produces combustion gas;

d) directing the flow of the combustion gas from the bore of the receiver, through the openings in the bore wall of the receiver, to the first chamber;

e) directing the flow of the combustion gas from the first chamber to the second chamber where the combustion gas is accelerated;

f) directing the flow of the accelerated combustion gas to the third chamber where the accelerated combustion gas is mixed with oxygen to cause an enhanced burning of the combustion gas;

g) directing the flow of the enhanced burning combustion gas from the third chamber to the fourth chamber where the enhanced burning combustion gas is caused to spin as it travels through the fourth chamber to cool the burning gas;

h) expelling the cooled gas from the second end of the housing through the plurality of gas vents.

19. The method of claim 18, wherein the outer wall section of the burn tube includes a plurality of grooves that facilitate the intermixing of the oxygen with the combustion gas to promote burning.

20. The method of claim 18, wherein the flash suppressor assembly further comprises a fifth chamber defined by a fifth inner wall surface portion of the tubular burn chamber and an end portion of the third outer wall section of the burn tube, and wherein the method further comprises the step:

g1) directing the cooled gas from the fourth chamber to the fifth chamber where the flow of the cooled gas is slowed before being expelled in step (h) through the plurality of gas vents to the exterior of the flash suppressor assembly.

* * * * *